US006305431B1

(12) United States Patent
Fenkes

(10) Patent No.: US 6,305,431 B1
(45) Date of Patent: Oct. 23, 2001

(54) CLEANING CLOTH

(75) Inventor: Herbert Fenkes, Viersen (DE)

(73) Assignee: Girmes In-Tex GmbH & Co. KG, Grefrath (DE)

( * ) Notice: Subject to any disclaimer, the term of this patent is extended or adjusted under 35 U.S.C. 154(b) by 0 days.

(21) Appl. No.: 09/327,277

(22) Filed: Jun. 4, 1999

(30) Foreign Application Priority Data

Jun. 9, 1998 (DE) ..... 298 10 240 U

(51) Int. Cl.[7] ..... D03D 27/00
(52) U.S. Cl. ..... 139/391; 139/392; 139/398
(58) Field of Search ..... 139/2, 7 E, 3, 139/391, 392, 394, 397, 398

(56) References Cited

U.S. PATENT DOCUMENTS

| | | | | |
|---|---|---|---|---|
| 1,846,245 | | 2/1932 | Bishop . | |
| 2,391,835 | | 12/1945 | Kavanagh . | |
| 3,865,678 | * | 2/1975 | Okamoto et al. | 428/91 |
| 4,756,340 | * | 7/1988 | Janssen | 139/397 |
| 5,655,573 | * | 8/1997 | Gheyson et al. | 139/21 |
| 5,801,274 | | 9/1998 | Nordin . | |
| 6,092,562 | * | 7/2000 | Debaes | 139/398 |

FOREIGN PATENT DOCUMENTS

| | | |
|---|---|---|
| 298 10 240 | 11/1998 | (DE) . |
| 0806505 | 11/1997 | (EP) . |

* cited by examiner

*Primary Examiner*—John J. Calvert
*Assistant Examiner*—Robert H. Muromoto, Jr.
(74) *Attorney, Agent, or Firm*—Herbert Dubno; Andrew Wilford

(57) ABSTRACT

A fabric suitable for use as a cleaning cloth has an array of parallel warp filaments and an array of ground weft filaments crossing and interwoven with the warp filaments forming a ground fabric. A first group of tuft-forming weft filaments is interwoven with the warp filaments and has ends exposed and forming pile on a face of the fabric. A second group of tuft-forming weft filaments is interwoven with the warp filaments and has ends exposed and forming pile on an opposite face of the fabric. These tuft-forming weft filaments are laced into the warp filaments.

3 Claims, 2 Drawing Sheets

CLEANING CLOTH

FIELD OF THE INVENTION

The present invention relates to a cleaning cloth. More particularly this invention concerns a pile fabric usable as a cleaning cloth.

BACKGROUND OF THE INVENTION

Pile cloth comprises a ground fabric, typically plain, rib, twill, or satin weave, from one face of which projects tufts forming the pile. The other face is smooth and clearly reveals the weave.

Such pile cloth is typically made by weaving two fabrics at the same time, each of a respective set of warp and weft yarns. An extra set of warp yarns is strung between the two fabrics and a certain number of the weft filaments for each fabric are in fact woven around these weft yarns. When the two fabrics are cut apart and the extra set of warp yarns is discarded, there is left a pair of fabrics each having one face bearing a pile formed by the cut ends of the weft filaments that were looped around the extra warp yarns.

For use as a wash cloth, it is desired to have pile on both sides. Thus the above-described pile fabrics are sewed together, back to back, so that both outer faces have pile. This labor- and material-intensive production unnecessarily elevates the cost of this mundane item. In addition the space between the two single-face pile fabrics can hold dirt and bacteria.

OBJECTS OF THE INVENTION

It is therefore an object of the present invention to provide an improved cleaning cloth.

Another object is the provision of such an improved cleaning cloth which overcomes the above-given disadvantages, that is which is inexpensive to manufacture and that does not provide a trap for bacteria and dirt.

A further object is the provision of an improved method of making the fabric for the cleaning cloth.

SUMMARY OF THE INVENTION

A cleaning cloth according to the invention is comprised of a ground fabric having two opposite faces each covered with pile formed of filaments laced into the ground fabric. Thus only a single ground fabric is needed, greatly reducing the cost to make the cleaning cloth according to the invention.

The pile in accordance with the invention is formed by tufts laced into the ground fabric. More specifically the filaments forming the pile are V-shaped for most economical use of materials or W-shaped for better hold.

To increase the absorbency of the cleaning cloth, the filaments forming the pile have raveled ends, that is their filaments are separated.

Different filaments can form the pile according to the inventions For instance the pile on one side can be formed by the ends of relatively stiff monofilaments for a good scrubbing action while the pile on the other side can be formed by softer natural-fiber filaments for polishing purposes.

The pile-forming filaments form different patterns on the faces.

Thus a fabric has according to the invention an array of parallel warp filaments and an array of ground weft filaments crossing and interwoven with the warp filaments and forming therewith a ground fabric of simple weave. A first group of tuft-forming weft filaments is interwoven with the warp filaments and has ends exposed and forming pile on a face of the fabric. A second group of tuft-forming weft filaments is interwoven with the warp filaments and has ends exposed and forming pile on an opposite face of the fabric.

A double-faced pile fabric is made according to the invention by forming two generally planar and spaced arrays of parallel ground warp filaments with each array having an inner side turned toward and spaced from the other array and an outer side turned away from the other array. A respective generally planar array of parallel extra warp filaments is arrayed at a spacing outward from each of the outer sides. The extra warp filaments are parallel to the ground warp filaments. Subsequently respective pluralities of ground weft filaments are woven between the ground warp filaments wholly out of contact with the extra warp filaments to form with each of the arrays of ground warp filaments a respective stable ground fabric. At the same time a plurality of pile weft filaments are woven between the ground warp filaments and between the extra warp filaments with the pile weft filaments crossing between the ground fabrics. Thereafter the extra warp filaments are cut between the ground fabrics to separate the ground fabrics and create pile-forming loose ends on the inner sides. Finally some of the loose ends are pulled through to the outer sides to form pile on the outer sides.

Each array of parallel ground warp filaments in accordance with the invention is formed by a plurality of groups of an odd number of adjacent ground filaments. The extra warp filaments are arrayed in pairs between the groups of ground warp filaments.

The cut ends of the tuft-forming weft filaments are pulled through after pulling out the extra warp filaments. This leaves free ends that are easily moved through the ground fabric to the other side.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
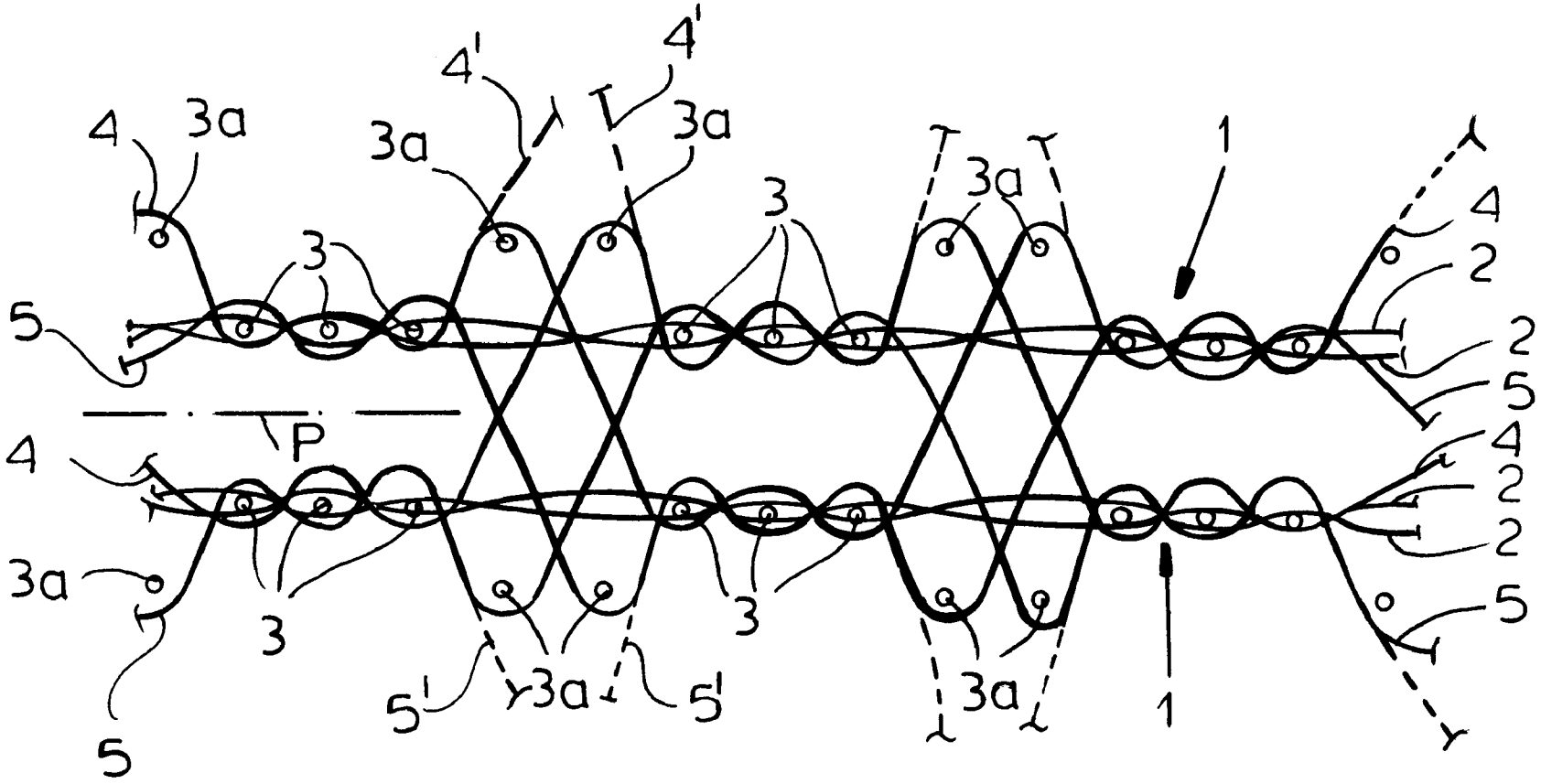
FIG. 1 is a diagrammatic end view illustrating the first step of how the fabric according to the invention is made.

As seen in FIG. 1 a pair of ground fabrics 1 are woven right next to each other, face to face, each formed by weft filaments 2 and warp filaments 3 in a plain linen weave. It is these filaments 2 and 3 that form the ground fabric that gives strength to the finished product.

According to the invention an extra set of warp filaments 3*a* interleaved with the filaments 3 is provided outside each outer face of each fabric 1. In the illustrated embodiment after every three ground warp filaments 3 there are two outer extra warp filaments 3*a*. The ground weft filaments 2 do not go near the extra warp filaments 3*a;* instead they simply pass back and forth between the ground warp filaments 3. Separate pile-forming weft filaments 4 and 5 are interleaved like the filaments 2 with the ground warp filaments 3, but also pass out and over the filaments 3*a* and then cross over to the other fabric 1 so that these filaments 4 and 5 join the two fabrics together along a plane P equidistant between them and also loop out over the outer warp yarns 3*a*.

Figure 2:
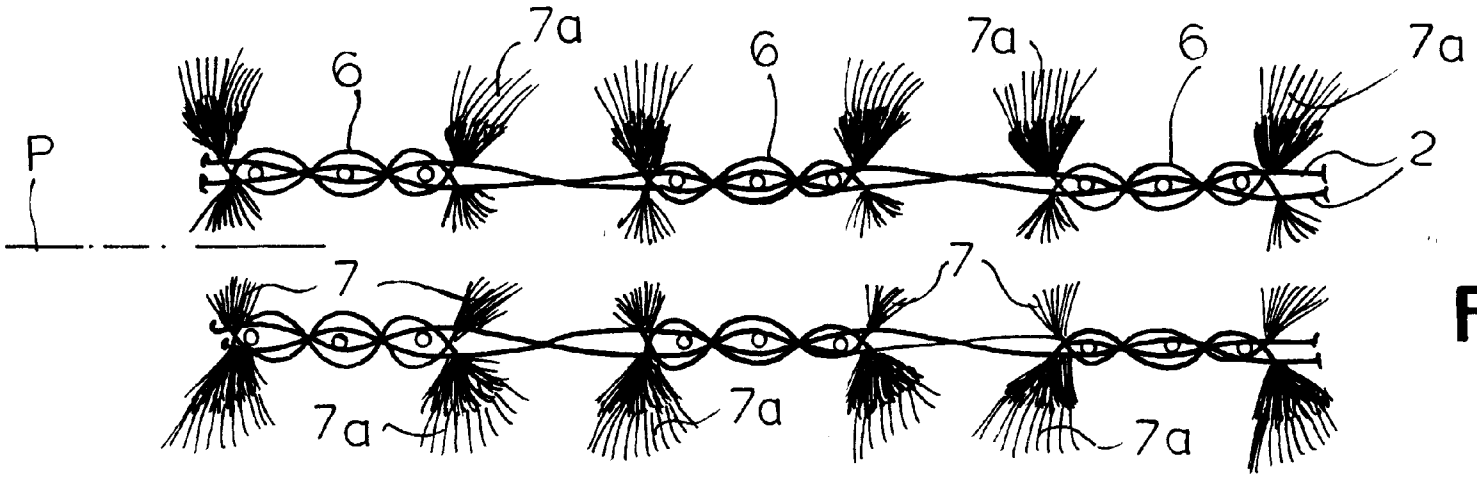
FIG. 2 is another end view illustrating the fabric after initial subdivision.
Figure 3:
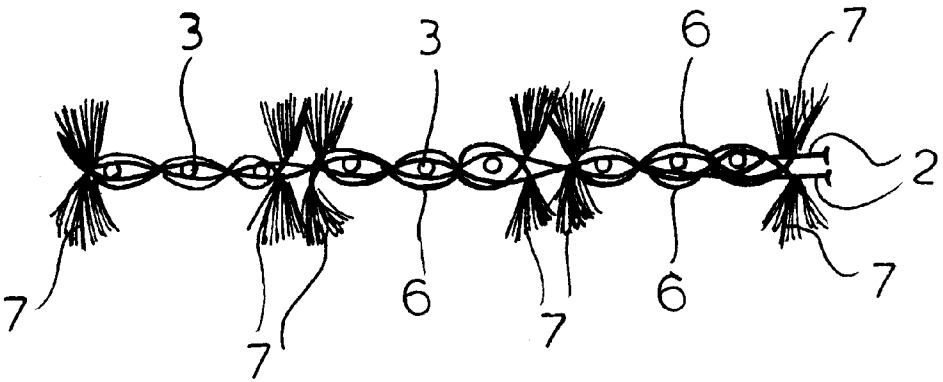
FIG. 3 is another end view illustrating the fabric after condensing.

Then the two fabrics are cut apart along the plane P. Obviously this leaves, as in the above-described double-cloth method of making pile, short pile-forming tufts 7 on the confronting faces of the fabrics 1. According to the invention however as shown in FIG. 2 the extra warp yarns 3*a* are raised or the fabrics 1 are brushed or combed on their outside to pull cut ends 4' and 5' through the fabrics 1 to their outer faces, forming long tufts 7*a* there. The tuft-forming yarns 4 and 5 are solidly anchored in a preferred W-shape, that is each looped over three warp yarns 3. These long tufts 7*a* are normally evened out by a second shearing to turn them into short tufts 7 as shown in FIG. 3.

Thus by providing the extra warp yarns 3*a* outside, not between, the fabrics 1 it is possible to produce two double-pile fabrics. Once the tension in the weft filaments 2 is relaxed, the remaining warp yarns 3 will move to a regular spacing from each other as shown in FIG. 3 to produce short nonpile wales 6 which may be so small as to be bridged by the tufts 7 or may produce a corduroy effect.

What is claimed is:

1. A method of making a double-faced pile fabric, the method comprising the steps of:

forming two generally planar and spaced arrays of parallel ground warp filaments, each array having an inner side turned toward and spaced from the other array and an outer side turned away from the other array;

arraying a respective generally planar array of parallel extra warp filaments at a spacing outward from each of the outer sides, the extra warp filaments being parallel to the ground warp filaments; thereafter weaving respective pluralities of ground weft filaments between the ground warp filaments and wholly out of contact with the extra warp filaments to form with each of the arrays of ground warp filaments a respective stable ground fabric;

weaving a plurality of pile weft filaments between the ground warp filaments and between the extra warp filaments with the pile weft filaments crossing between the ground fabrics; thereafter cutting the extra warp filaments between the ground fabrics and thereby separating the ground fabrics and creating pile-forming loose ends on the inner sides; and thereafter pulling some of the loose ends through to the outer sides and thereby forming pile on the outer sides.

2. The method defined in claim 1 wherein each array of parallel ground warp filaments is formed by a plurality of groups of an odd number of adjacent ground filaments.

3. The method defined in claim 2, further comprising the step after weaving of the pile weft filaments between the ground warp filaments and before pulling some of the loose ends through to the other sides of:

pulling out the extra warp filaments.

* * * * *